US011697907B2

(12) United States Patent
Okamura et al.

(10) Patent No.: US 11,697,907 B2
(45) Date of Patent: Jul. 11, 2023

(54) METHOD FOR PRODUCING COLORED EMBROIDERY PATTERN

(71) Applicant: IMEX CO., LTD., Hiratsuka (JP)

(72) Inventors: Kazuma Okamura, Okayama (JP); Isamu Esashika, Hiratsuka (JP); Hajime Kambara, Okayama (JP)

(73) Assignee: IMEX CO., LTD., Kanagawa (JP)

( * ) Notice: Subject to any disclaimer, the term of this patent is extended or adjusted under 35 U.S.C. 154(b) by 17 days.

(21) Appl. No.: 17/491,940

(22) Filed: Oct. 1, 2021

(65) Prior Publication Data

US 2022/0106736 A1 Apr. 7, 2022

(30) Foreign Application Priority Data

Oct. 6, 2020 (JP) ..... 2020-168905

(51) Int. Cl.

| | |
|---|---|
| ***D06P 5/00*** | (2006.01) |
| ***D06P 5/28*** | (2006.01) |
| ***D05C 11/24*** | (2006.01) |
| ***D05C 17/00*** | (2006.01) |
| ***D06P 1/16*** | (2006.01) |
| ***D06P 5/20*** | (2006.01) |

(52) U.S. Cl.

CPC ..... *D06P 5/006* (2013.01); *D05C 11/24* (2013.01); *D05C 17/00* (2013.01); *D06P 1/16* (2013.01); *D06P 5/2055* (2013.01)

(58) Field of Classification Search

CPC ..... D06P 5/006; D06P 1/16; D06P 5/2055; D06P 5/004; D05C 11/24; D05C 17/00

USPC ..... 8/471

See application file for complete search history.

(56) References Cited

U.S. PATENT DOCUMENTS

| | | | | |
|---|---|---|---|---|
| 4,132,833 A | | 1/1979 | Sandhu | |
| 4,439,202 A | * | 3/1984 | Sernaker | D06P 5/003 428/906.6 |
| 2011/0041741 A1 | * | 2/2011 | Cohen | D06P 5/13 112/439 |

FOREIGN PATENT DOCUMENTS

| | | | |
|---|---|---|---|
| CN | 103114394 A | | 5/2013 |
| CN | 101591842 B | * | 9/2013 |

(Continued)

OTHER PUBLICATIONS

Extended European Search Report issued in European Patent Application No. 21200906.2 dated Mar. 9, 2022.

*Primary Examiner* — Eisa B Elhilo
(74) *Attorney, Agent, or Firm* — Nixon & Vanderhye

(57) ABSTRACT

Disclosed is a method for producing an embroidery pattern through stitching to a substrate, particularly a method for producing a colored embroidery pattern having color disposition corresponding to a complex shape or stitches, simply and at low cost. The method includes: forming an embroidery base pattern to a substrate by use of single-color embroidery thread; printing a transfer image on an intermediate recording medium having a total light transmittance Tt of 60% or higher by use of a sublimable disperse dye, the transfer image being used for dyeing the embroidery thread of the embroidery base pattern; superposing the transfer image on the embroidery base pattern, while the intermediate recording medium is positioned from the backside of a printed surface of the recording medium; and heat-pressing the intermediate recording medium from the backside of the recording medium, to thereby dye the embroidery thread of the embroidery base pattern.

5 Claims, 3 Drawing Sheets

(56) References Cited

FOREIGN PATENT DOCUMENTS

| | | | | | |
|---|---|---|---|---|---|
| CN | 102747623 | B | * | 7/2014 | |
| CN | 103952873 | A | | 7/2014 | |
| CN | 109835078 | A | | 6/2019 | |
| CN | 111254605 | A | * | 6/2020 | |
| JP | S48-075893 | A | | 10/1973 | |
| JP | 58-203154 | | | 11/1983 | |
| JP | 60-134059 | | | 7/1985 | |
| JP | 10-058638 | | | 3/1998 | |
| JP | 2982427 | | | 9/1999 | |
| JP | 2982427 | B2 | * | 11/1999 | ..... D05B 21/00 |
| JP | 2000-029238 | | | 1/2000 | |
| JP | 2005248376 | A | * | 9/2005 | |
| JP | 2013-212609 | A | | 10/2013 | |
| WO | 2006/129744 | | | 12/2006 | |
| WO | WO 2006/129744 | A1 | * | 12/2006 | ..... D06P 5/00 |
| WO | 2016/029176 | A1 | | 2/2016 | |

* cited by examiner

METHOD FOR PRODUCING COLORED EMBROIDERY PATTERN

The entire disclosure of Japanese Patent Application No. 2020-168905 filed on Oct. 6, 2020 is expressly incorporated by reference herein.

BACKGROUND OF THE INVENTION

Field of the Invention

The present invention relates to a method for producing an embroidery pattern (hereinafter may also be referred to as an "embroidering method") through stitching to a substrate, such as cloth. More particularly, the invention relates to a method for producing a colored embroidery pattern having color disposition corresponding to a complex shape or stitches.

Description of the Related Art

Conventionally, color embroidered parts have been formed with single-colored embroidery thread or a plurality of colored embroidery threads. However, when embroidery threads of a plurality of colors are employed so as to establish color disposition of an embroidery pattern, the number of colors to be provided is limited by the number of colored embroidery threads. Particularly in industrial color embroidering, limitation is imposed on the production facility and production cost, and storage of a variety of expensive colored embroidery threads is risky and disadvantageous. Under such circumstances, the number of colors of embroidery threads is considerably limited. As a result, it has been impossible to embroider fabric provided with a complex color pattern.

For providing a complex color pattern, there is proposed a coloring/dyeing method including post-dyeing of an embroidered part by use of a transfer paper sheet (see, for example, Patent Document 1). Particularly, a sublimable dye-type transfer paper sheet is often used, since a sublimable dye provides a favorable color tone and good wash fastness. However, generally, the transfer surface of a transfer paper sheet is fully coated with a dye, and the color pattern of the dye is transferred to a part of the fabric other than the embroidered part. In this case, expression of the embroidered part is problematically impaired (e.g., blurring of the edge of the embroidered part). Another proposed method involves masking, with a masking material, a part other than the embroidered part before coloring/dyeing with a transfer paper sheet (see, for example, Patent Document 2). However, even when masking has been performed, difficulty is encountered in providing a design having color disposition corresponding to a complex shape or stitches.

In order to correctly position the stitches with a dye, there has been devised an embroidering machine provided with a transfer trowel (or iron) (see Patent Document 3). However, this embroidering machine requires a specially designed member, and the shape of the trowel (or iron) must be changed design by design. Thus, employment of the machine is limited.

There is also proposed a method of bonding an embroidered part to a printing part of a transfer paper sheet, the method including cutting the peripheral part of the embroidered part of the substrate and employing a cut piece as a badge (i.e., Wappen) or an applique (see Patent Document 4). However, application of this method is limited to a cut substrate (e.g., a badge), and the method is not applicable to a process, for example, embroidering to sewn clothes and post dyeing.

Meanwhile, there has been widely employed a digital print sublimation transfer dyeing method through an ink-jet technique or an electrophotographic technique (see Patent Documents 5 and 6). In such a method, an image is formed on an intermediate recording medium by use of an ink or toner containing a sublimable dye by means of a digital printer; laminating the intermediate recording medium with a dyeing target (e.g., fabric) followed by heating; and performing dyeing on the basis of sublimability of the dye. By virtue of image formation by means of a digital printer, a fine design can be provided. The intermediate recording medium employed in the method is generally a non-transparent paper sheet so as to satisfy both absorbability with respect to an ink or the like and prevent dye penetration. Thus, difficulty is encountered in fine positioning of a design with visually identifying stitches of the embroidered part.

In order to solve this problem, there is employed a general procedure including cutting the intermediate recording medium to a piece fitted to printing in advance, and positioning according to the outline of the cut piece. However, cutting pieces requires a long time and a special apparatus. Also, even when positioning can be generally achieved in some designs, difficulty is encountered in positioning color disposition in accordance with the orientations of stiches and the like. Thus, mispositioning (e.g., variance in angle) may occur.

Patent Document 1: Japanese Patent Application Laid-Open (kokai) No. 1983-203154

Patent Document 2: WO2006/129744

Patent Document 3: Japanese Patent No. 2982427

Patent Document 4: Japanese Patent Application Laid-Open (kokai) No. 1985-134059

Patent Document 5: Japanese Patent Application Laid-Open (kokai) No. 1998-058638

Patent Document 6: Japanese Patent Application Laid-Open (kokai) No. 2000-029238

SUMMARY OF INVENTION

Summary of the Invention

Under such circumstances, an object of the present invention is to provide a method for producing an embroidery pattern through stitching to a substrate, such as cloth, and more particularly, to provide a method for producing a colored embroidery pattern having color disposition corresponding to a complex shape or stitches, at low cost and in a simple manner.

Solution to Problem

The present inventors have conducted extensive studies so as to attain the aforementioned object, and have found that, by use of an intermediate recording medium having a total light transmittance Tt of 60% or higher, an embroidery pattern formed of single-color embroidery thread can be post-dyed to a high degree through superposing the intermediate recording medium on the stitches of the embroidery pattern with positioning from the backside of a printed surface of the recording medium, and heat-pressing. The present invention has been accomplished on the basis of this finding.

The present invention for attaining the object is as follows.

Mode 1

A method for producing a colored embroidery pattern, the method comprising the steps of:

forming an embroidery base pattern to a substrate by use of single-color embroidery thread;

printing a transfer image on an intermediate recording medium having a total light transmittance Tt of 60% or higher by use of a sublimable disperse dye, the transfer image being used for dyeing the embroidery thread of the embroidery base pattern;

superposing the transfer image on the embroidery base pattern, while the intermediate recording medium is positioned from the backside (i.e., opposite side) of a printed surface of the recording medium; and heat-pressing the intermediate recording medium from the backside of the recording medium, to thereby dye the embroidery thread of the embroidery base pattern.

Mode 2

A colored embroidery pattern production method according to mode 1, wherein printing on the intermediate recording medium is performed through an electrophotographic technique employing a toner containing a sublimable dye.

Mode 3

A colored embroidery pattern production method according to mode 1 or 2, wherein the intermediate recording medium is a sheet having a multi-layer structure including at least a print surface layer formed of cellulose and a resin layer.

Mode 4

A colored embroidery pattern production method according to mode 3, wherein, in formation of the embroidery base pattern, a water-soluble resin sheet is superposed on a surface of the substrate, to thereby stitch the water-soluble resin sheet into the embroidery base pattern.

Mode 5

A colored embroidery pattern production method according to mode 4, wherein, in formation of the embroidery base pattern, the surface of the substrate and the water-soluble resin sheet are fixed in a frame member, while the surface and the resin sheet are in a stacked state.

Advantageous Effects of Invention

According to the colored embroidery pattern production method of the present invention, in sublimation transfer, an intermediate recording medium having a total light transmittance Tt of 60% or higher is used. The intermediate recording medium is superposed on stitches with positioning from the backside of a printed surface of the recording medium, and the stacked body is pressed with heat, whereby an embroidery pattern formed of single-color embroidery thread is post-dyed. This procedure can be applied to a design having color disposition corresponding to a complex shape or stitches. Thus, a high-quality and correct color embroidered pattern can be produced at low cost and in a simple manner.

DESCRIPTION OF THE PREFERRED EMBODIMENTS

Figure 1:
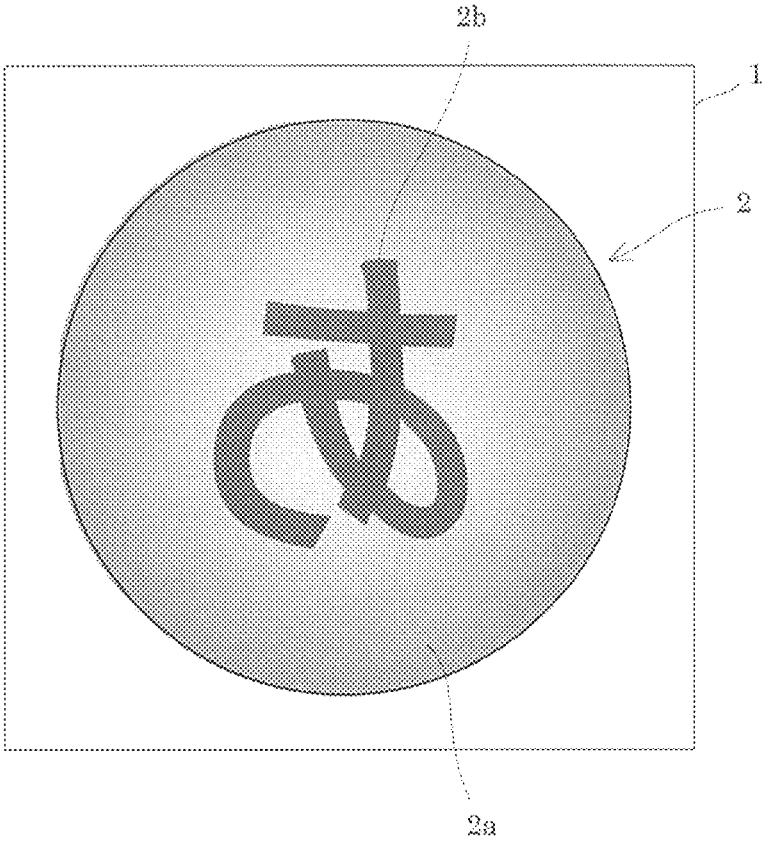
FIG. 1: A sketch of a transfer image printed on an intermediate recording medium of an example.

The present invention will next be described in detail.

The present invention is directed to a method for producing a colored embroidery pattern, which method includes the steps of: forming an embroidery base pattern to a substrate by use of single-color embroidery thread; printing a transfer image on an intermediate recording medium having a total light transmittance Tt of 60% or higher by use of a sublimable disperse dye, the transfer image being used for dyeing the embroidery thread of the embroidery base pattern; superposing the transfer image on the embroidery base pattern, while the intermediate recording medium is positioned from the backside (i.e., opposite side) of a printed surface of the recording medium; and heat-pressing the intermediate recording medium from the backside of the recording medium, to thereby dye the embroidery thread of the embroidery base pattern.

According to the present invention, a transfer image for dyeing the embroidery thread of the embroidery base pattern is printed on an intermediate recording medium having a total light transmittance Tt of 60% or higher by use of a sublimable disperse dye. Since an intermediate recording medium having a total light transmittance Tt of 60% or higher is used, the intermediate recording medium provided with a transfer image is superposed on the embroidery base pattern, while the transfer image can be visually positioned from the backside of the recording medium. Thus, the transfer image can be superposed with positioning on the embroidery base pattern without cutting the transfer image. In other words, even when the transfer image of the target embroidery base pattern has a complex shape, or even when a transfer image is superposed on a part of the embroidery base pattern, the transfer image can be visually positioned to stitches from the backside of the recording material without cutting thereof. Thus, transfer dyeing can be achieved at a high degree of color disposition.

No particular limitation is imposed on the intermediate recording medium, so long as the recording medium is made of a material having resistance to transfer temperature (i.e., a heat resistance 200° C. or higher) and exhibits a total light transmittance Tt of 60% or higher. The total light transmittance Tt of the intermediate recording medium is essentially 60% or higher, preferably 70% or higher, more preferably 85% or higher.

Also, no particular limitation is imposed on the intermediate recording medium used in the present invention, so long as the recording medium allows printing by means of a digital printer employed in the invention. For example, transparent paper (e.g., natural tracing paper), transparent resin film, etc. having a transparency of interest may be used. Among such media, a particularly preferred example is a sheet having a multi-layer structure including at least a print surface layer formed of cellulose and a heat-resistant resin layer. Printability provided by a digital printer varies in accordance with the thickness of the intermediate recording medium. However, the thickness represented by the basis weight is preferably 55 to 160 g/m$^2$, more preferably 65 to 120 g/m$^2$.

In the present invention, any method for printing a sublimable disperse dye on the intermediate recording medium may be employed, so long as the printing method employs an ink or toner containing a sublimable disperse dye. Among such methods, an electrophotographic technique employing a toner containing a sublimable disperse dye is particularly preferred, from the viewpoint of ease of printing to an intermediate recording medium having high total light transmittance.

In the present invention, the accuracy of positioning between the embroidery base pattern formed to the substrate and the transfer image is high, and staining of a part other than the embroidered part is less likely to occur. Therefore, masking of the peripheral part of the embroidery base pattern is not necessarily provided. However, in order to completely avoid possible staining of the part other than the embroidery base part, a water-soluble resin sheet may be stitched in advance into the embroidery base pattern. In other words, through forming an embroidery base pattern while the water-soluble sheet is superposed on the substrate, the water-soluble resin sheet can be stitched in advance into the embroidery base pattern. As a result, even less possible staining of a part other than the embroidery base pattern can be completely avoided during dye transfer.

Notably, in forming an embroidery base pattern while the water-soluble sheet is superposed on the substrate, an embroidery base pattern is preferably formed, while the substrate and the water-soluble resin sheet are fixed in a frame member. When such a frame member is employed, the embroidery base pattern can be formed at higher accuracy. In addition, through performing transfer dyeing while the substrate and resin sheet are fixed in a frame member, the pattern of the transfer image provided on the intermediate recording medium can be positioned with respect to the embroidery base pattern at high accuracy.

Therefore, the frame member is preferably used, even when no water-soluble sheet is employed.

The water-soluble sheet which may be used in the present invention is any of various known sheets such as a water-soluble resin sheet or water-soluble paper. Examples of such a sheet include a water-soluble resin sheet formed of a polyvinyl alcohol (PVA) resin.

[Single-Color Embroidered Pattern Production Method]

In the present invention, no particular limitation is imposed on the method of forming an embroidery base pattern (i.e., a single-color embroidery pattern) as a dyeing target. The base pattern may be formed manually or by means of an embroidering machine such as a computer-assisted sewing machine. However, in order to facilitate positioning with a transfer image formed by means of a digital printer, an embroidering machine such as a computer-assisted sewing machine is preferably employed. In this case, a single-color embroidery pattern having the same shape and dimensions as those of the transfer image can be formed by processing printing image data by the software dedicated to the sewing machine and instructing the shape and stitching manner of the embroidery pattern to the sewing machine.

The embroidery thread is required to have facility to dyeing with a sublimable disperse dye and heat resistance. From this viewpoint, polyester fiber thread is preferred. However, the embroidery thread is not limited thereto, and nylon thread and the like may be used.

No particular limitation is imposed on the material of the substrate to which an embroidery pattern is formed, so long as the substrate allows passage of an embroidery lace needle and is not deteriorated by heat treatment performed in the below-mentioned sublimation transfer process. Synthetic fiber (e.g., polyester or nylon) fabric may be used, and cotton and linen are preferred from the viewpoint of resistance to staining with excessive dye.

[Sublimation Transfer Dyeing Method]

In the present invention, sublimation transfer dyeing is performed in the following manner. Firstly, a target image is formed on an intermediate recording medium having a total light transmittance Tt of 60% or higher by means of a digital printer or a multifunction printer with an ink or toner containing a sublimable disperse dye. Then, during overlaying of the image-formed surface of the intermediate recording medium onto a substrate (e.g., a cloth substrate) provided with a single-color embroidery pattern, the intermediate recording medium is visually positioned to stitches of the embroidery pattern from the backside of the print surface of the recording medium. Finally, the product is heat-pressed at a predetermined temperature for a predetermined time by means of a sublimation transfer apparatus. The more specific procedure is as follows.

Any known sublimation transfer dyeing method may be employed in the present invention, so long as heating can be performed at a predetermined temperature and pressure for a predetermined period of time. However, in order to further enhance positioning accuracy, use of a small trowel for dressmaking or Cricut Easy Press (product of Cricut, US) is particularly preferred, since such a tool achieves heat pressing of the dye transfer target while being stretched in a frame to which the substrate has been fixed for embroidering.

Examples of the sublimation transfer apparatus employed in the present invention include a continuous sublimation transfer apparatus equipped with a drum heater (e.g., HSR-600R, product of HASHIMA); a flat sublimation transfer apparatus which effects sublimation transfer in a manner where one cut piece of an intermediate recording medium (transfer paper sheet) is superposed on one cut piece of fabric (e.g., HSP-126FA, product of HASHIMA, or NAP-502, product of Asahi Garment Machinery Co., Ltd.); and a vacuum sublimation transfer apparatus which can promote sublimation of a dye under reduced pressure (e.g., HSP-1513PV-AT, product of HASHIMA, or STP-800, product of Asahi Garment Machinery Co., Ltd.). These apparatuses may be chosen in accordance with dimensions and the purpose of use.

The heating temperature in sublimation transfer is generally 180° C. to 220° C., from the viewpoints of the sublimation temperature of a target sublimable dye and prevention of thermal decomposition of a colored body (e.g., fabric), more preferably 190° C. to 210° C. The heating time is 30 seconds to a maximum of about 10 minutes. These conditions may be tuned in consideration of the type of substrate and thread and in accordance with the purpose and dyeing performance.

Through the above heat treatment, molecules of the sublimable dye contained in the ink or toner for forming the image printed on the intermediate recording medium are vaporized. These molecules enter into a molecular chain gap of the embroidery thread, whereby the embroidery pattern is dyed. After completion of heating, the product is cooled to ambient temperature, and the intermediate recording medium is delaminated from the substrate. Thus, the sublimation transfer dyeing of the present invention is complete.

EXAMPLES

[Total Light Transmittance of Intermediate Recording Medium]

The total light transmittance Tt of each of the intermediate recording media employed in the Examples and Comparative Examples was measured by means of Hazemeter HZ-V3 (product of Suga Test Instruments Co., Ltd.).

[Dye Image Formation on Intermediate Recording Medium]

A test pattern as shown in FIG. 1 was provided. Specifically, a transfer image 2 was printed on an intermediate recording medium 1 by means of a laser printer SDP A410 (product of IMEX Co., Ltd.). A background 2*a* of the transfer image 2 had a color gradation including a peripheral portion of cyan 100% and a core portion of cyan 30%. A character 2*b* was a red image created from magenta (100%) and yellow (100%). Notably, the transfer image 2 served as a reverse image of the below-mentioned embroidery base pattern 4.

[Production of Single-Color Embroidery Pattern]

Figure 2:
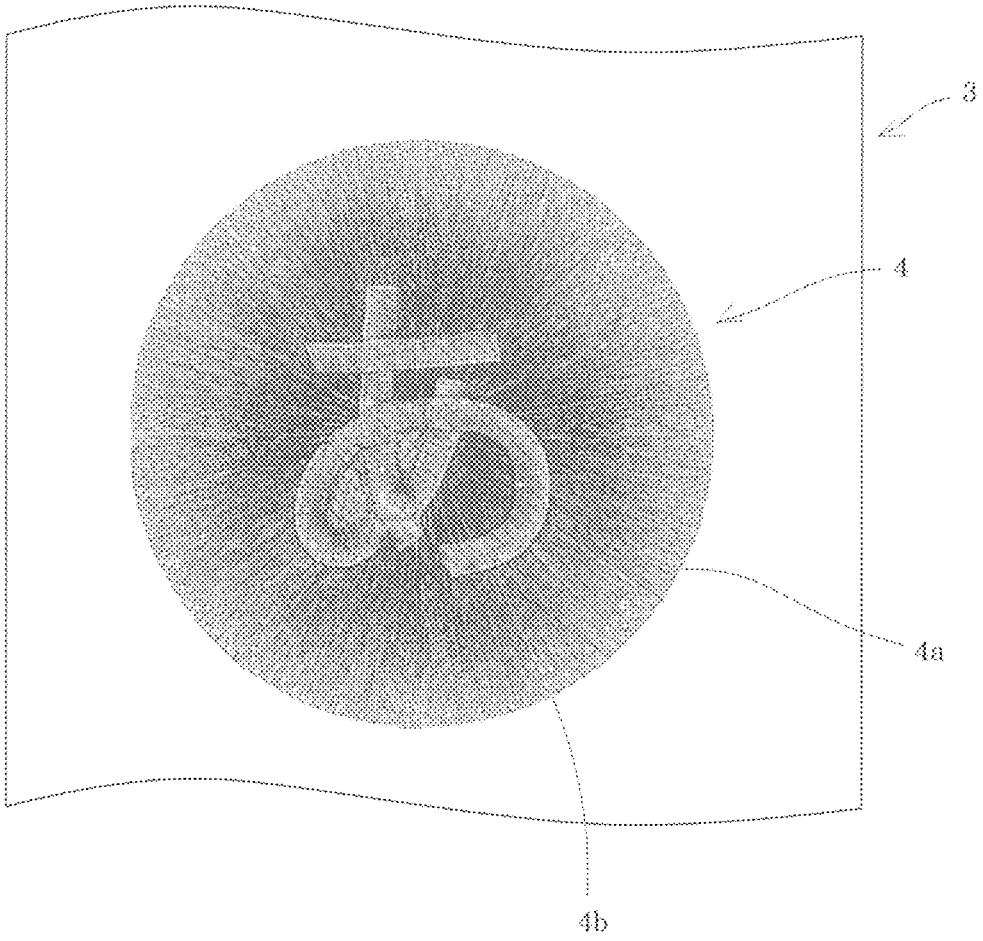
FIG. 2: A sketch of a substrate of an example to which an embroidery base pattern has been stitched.

An embroidery pattern produced by embroidering software Pro Next (product of Brother Industries, Ltd.) was read into a computer-assisted sewing machine FM-2000D (product of Brother Industries, Ltd.). As shown in FIG. 2, sheeting fabric (cotton 100%, white) serving as a substrate 3 was provided with a base embroidery pattern 4 by use of embroidery thread ULTRAPOS (product of Brother Industries, Ltd., white, polyester 100%). A background portion 4*a* of the embroidery base pattern 4 was fabricated on the basis of radial stitch. A character portion 4*b* was fabricated on the basis of satin stitch, and the orientation of stitch was aligned toward a short side direction of the character.

[Assessment of Positioning Easiness]

Figure 3:
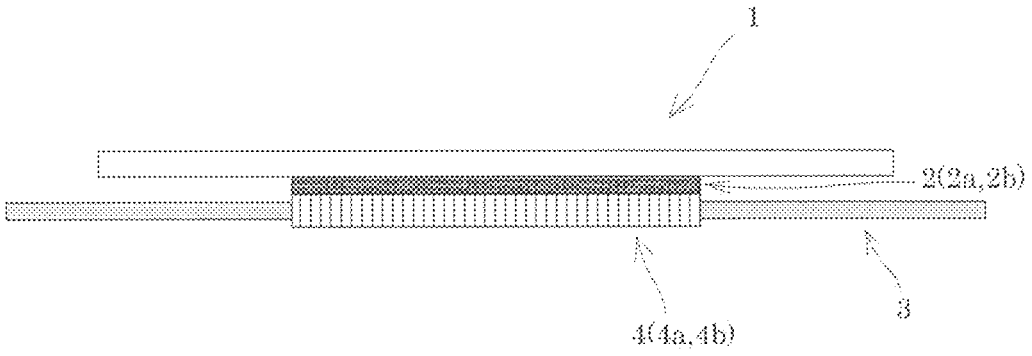
FIG. 3: A cross-sectional view describing superposing a transfer image on an embroidery base pattern.

As shown in FIG. 3, the aforementioned intermediate recording medium 1 was superposed on the aforementioned embroidery base pattern 4 (a single-color embroidery pattern), such that the printed surface oppositely faced to the embroidery. The embroidery base pattern 4 was superposed on the transfer image 2, and the character 2*b* was completely positioned onto the character portion 4*b* through visual positioning from the backside of the intermediate recording medium 1. Operability of the above procedure was assessed on the basis of the following ratings.

O: Excellent. Disposition of character and stitches can be readily identified.

Δ: Some effort is required to match the disposition of the character to stitches, although the outer circle of the design can be identified.

X: Outer circle of the design cannot be identified from the backside. Efforts such as cutting are required.

[Assessment of Printability]

In printing by means of the above-described printer, a certain modification and some restriction of printing conditions were required, depending on the type of intermediate recording medium used. Easiness of printing was assessed on the basis of the following ratings.

OO: Printing is possible without any particular restriction under the conditions set and recommended by the printer manufacture.

O: Modification of paper setting conditions is required, and printing conditions including temperature and humidity are required to be limited.

Δ: Printing is impossible by only modifying the printing conditions. Bonding with glue and other treatment are required.

X: Difficulty in printing.

[Sublimation Transfer]

Patchwork iron 57-904 (product of Clover Mfg. Co., Ltd. was preliminarily heated to 180 to 200° C. (high temp. mode). The printed portion of the intermediate recording medium positioned through the aforementioned procedure was heated by the patchwork iron for 1 minute. The pressure of pressing was not measured, but was equivalent to a pressure of lightly pressing to an ironing board by hand. While coloring by heat was observed, the entire printed portion was heated for 1 minute or longer by repeatedly heating with the iron at two to three different positions. Although some areas were unintentionally heated repeatedly, quality including dye density was not changed.

The above test results are shown in Table 1.

TABLE 1

| | | Ex. 1 | Ex. 2 | Ex. 3 | Ex. 4 |
|---|---|---|---|---|---|
| Type | | Multilayer sheet | Multilayer sheet | Multilayer sheet | Multilayer sheet |
| Manufacturer | | Mitsubishi Paper Mills Ltd. | Yashima Sangyo Co., Ltd. | Sakurai Co., Ltd. | Matsumoto Youshi |
| Tradename | | Richlight TF70 | Stuck Tracing | LPEX | MS Tracing |
| Basis weight | $g/m^2$ | 70 | 70 | 70 | 150 |
| Haze | % | 78.9 | 78.9 | 80.4 | 79.7 |
| Tt | % | 88.2 | 89.5 | 62.0 | 77.9 |
| Ease of positioning | | ○ | ○ | Δ | Δ |
| Ease of printing | | ○○ | ○○ | ○*1 | ○*2 |

| | | Ex. 5 | Ex. 6 | Comp. Ex. 1 | Comp. Ex. 2 |
|---|---|---|---|---|---|
| Type | | Monolayer transparent | Monolayer transparent | Plain paper (made in JP) | Plain paper (made in US) |
| Manufacturer | | Kokuyo Co., Ltd. | Kokuyo Co., Ltd. | ASKUL Corporation | Boise |
| Tradename | | Natural tracing paper | Natural tracing paper | Super Economy | Multi-use Copy Paper |
| Basis weight | $g/m^2$ | 75 | 40 | 68 | 75 |
| Haze | % | 79.2 | 79.2 | 80.4 | 80.5 |
| Tt | % | 89.3 | 87.7 | 25.0 | 17.1 |
| Ease of positioning | | ○ | ○ | X | X |
| Ease of printing | | ○*3 | Δ*4 | ○○ | ○ |

*1Rigorous temperature control required. Occasional uneven density difference.

*2Fixation complete only for a thick paper sheet at low printing speed.

*3Rigorous temperature control required. Occasional paper jam.

*4Paper-feed incomplete. Sticking on mount, printing, peeling, and then transfer.

DESCRIPTION OF REFERENCE NUMERALS

1 intermediate recording medium
2 transfer image
2*a* background
2*b* character
3 substrate
4 embroidery base pattern
4*a* background portion
4*b* character portion

The invention claimed is:

1. A method for producing a colored embroidery pattern, the method comprising the steps of:

forming an embroidery base pattern to a substrate by use of single-color embroidery thread;

printing a transfer image on an intermediate recording medium having a total light transmittance Tt of 60% or higher by use of a sublimable disperse dye, the transfer image being used for dyeing the embroidery thread of the embroidery base pattern;

superposing the transfer image on the embroidery base pattern, while the intermediate recording medium is positioned from the backside of a printed surface of the recording medium; and heat-pressing the intermediate recording medium from the backside of the recording medium, to thereby dye the embroidery thread of the embroidery base pattern.

2. The colored embroidery pattern production method according to claim 1, wherein printing on the intermediate recording medium is performed through an electrophotographic technique employing a toner containing a sublimable dye.

3. The colored embroidery pattern production method according to claim 1, wherein the intermediate recording medium is a sheet having a multi-layer structure including at least a print surface layer formed of cellulose and a resin layer.

4. The colored embroidery pattern production method according to claim 3, wherein, in formation of the embroidery base pattern, a water-soluble resin sheet is superposed on a surface of the substrate, to thereby stitch the water-soluble resin sheet into the embroidery base pattern.

5. The colored embroidery pattern production method according to claim 4, wherein, in formation of the embroidery base pattern, the surface of the substrate and the water-soluble resin sheet are fixed in a frame member, while the surface and the resin sheet are in a stacked state.

* * * * *